United States Patent [19]

Furgerson et al.

[11] Patent Number: 4,750,735

[45] Date of Patent: Jun. 14, 1988

[54] ADJUSTABLE HYDRAULIC LOAD-RESISTING MECHANISMS FOR EXERCISE MACHINES

[75] Inventors: David J. Furgerson, Redmond; Allan F. Strickland, Bothell, both of Wash.

[73] Assignee: M & R Industries, Inc., Redmond, Wash.

[21] Appl. No.: 917,163

[22] Filed: Oct. 9, 1986

[51] Int. Cl.[4] ..... A63B 69/06; F16F 5/00

[52] U.S. Cl. ..... 272/72; 272/130; 188/313

[58] Field of Search ..... 272/72, 73, 130, 67, 272/68; 128/25 R; 188/313, 315, 318

[56] References Cited

U.S. PATENT DOCUMENTS

| | | | |
|---|---|---|---|
| 1,015,071 | 1/1912 | Reach | 272/72 |
| 2,838,140 | 6/1958 | Rasmusson et al. | 188/313 |
| 3,084,709 | 4/1963 | Flick et al. | 188/313 |
| 3,107,753 | 10/1963 | Georgette | 188/313 |
| 3,495,824 | 2/1970 | Cuinier | 272/67 |
| 4,448,412 | 5/1984 | Brentham | 272/130 |
| 4,541,627 | 9/1985 | MacLean et al. | 272/72 |
| 4,566,692 | 1/1986 | Brentham | 272/130 |
| 4,629,185 | 12/1986 | Amann | 272/72 |

*Primary Examiner*—Richard J. Apley
*Assistant Examiner*—S. R. Crow
*Attorney, Agent, or Firm*—Seed and Berry

[57] ABSTRACT

An exercise rowing machine has a frame and a swing arm pivotally connected thereto which is manually pushed and pulled in opposition to an adjustable hydraulic load-resisting mechanism pivotally connected between the frame and the arm. This mechanism has a pair of spring-loaded, independently adjustable flow control valves at opposite ends for controlling flow to and from opposite ends of a cylinder which a double-acting piston reciprocates responsive to movement of the swing arm. The range of adjustment of the spring pressure on the valves is preset.

12 Claims, 3 Drawing Sheets

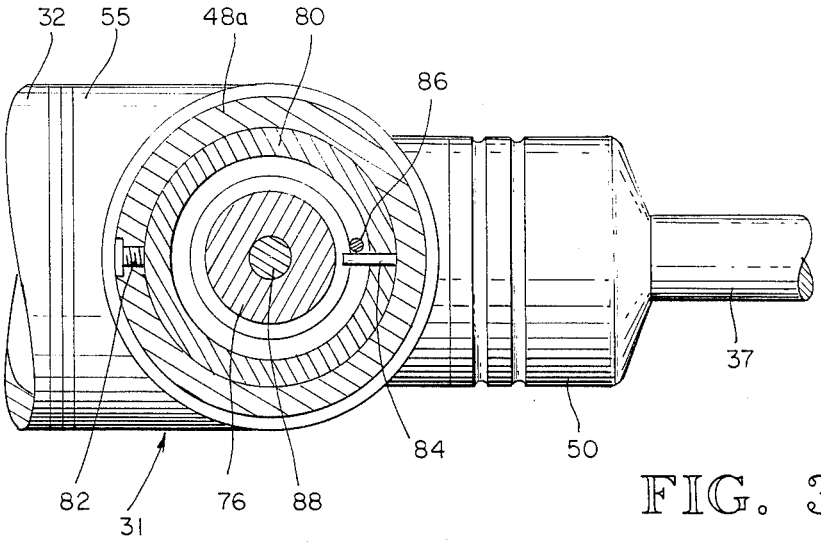
FIG. 3
FIG. 4
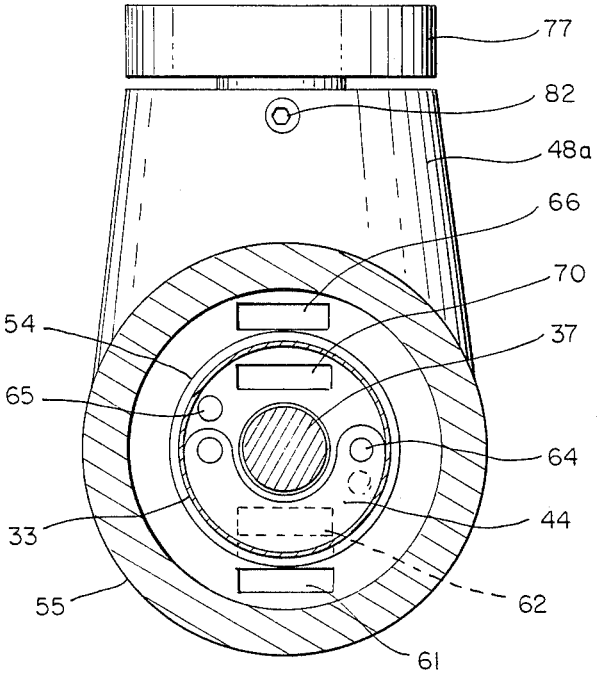

ADJUSTABLE HYDRAULIC LOAD-RESISTING MECHANISMS FOR EXERCISE MACHINES

TECHNICAL FIELD

The present invention relates to hydraulic load-resisting mechanisms similar to double-acting shock absorbers of the general type commonly used on exercise rowing machines to yieldingly resist movement of rowing arms, and more specifically relates to hydraulic load-resisting mechanisms whch are adjustable as to load resistance.

BACKGROUND ART

Exercise equipment, such as, for example, exercise rowing machines, commonly employ hydraulic cylinder units with double-acting pistons to resist movement of pivoted arms to be manipulated for exercise. Commonly, in the case of exercise rowing machines, the rowing arms and the cylinder component of the hydraulic cylinder units have been pivotally connected to the machine frame, and the piston rod has been pivotally connected to the rowing arms to resist movement thereof. To vary the resistance exerted by each hydraulic cylinder unit to arm movement, it has been the practice to adjust the distance from the pivotal connection between the piston rod and arm and the pivotal connection between the arm and the frame. Such adjustment does not provide independent adjustment of the resistance to arm movement in the pulling and pushing directions and normally does not enable fine adjustment of the resistance to be easily accomplished.

DISCLOSURE OF THE INVENTION

The present invention provides a load-resisting hydraulic device which permits easy fine adjustment of the resistance to movement of a double-acting piston, and permits independent adjustment of the resistance to movement of the piston in opposite directions. In doing so, there is provided concentric inner and outer cylinders interfitting with end block assemblies to form an elongated outer reservoir chamber between the cylinders and an elongated inner chamber within the inner cylinder for receiving a double-acting piston having a piston rod extending slidably through one of the end block assemblies. Each of the end block assemblies has an end block attached to the outer cylinder and an inner circular porting member receiving an end of the inner cylinder. The porting members each have a return port covered by a flapper-type check valve communicating with the outer chamber, and each has a discharge port communicating with the outer chamber via a seat for a respective spring-urged flow control valve which comprises part of a respective adjusting mechanism, there being an independent adjusting mechanism in each end block assembly.

The spring pressure on each valve is adjusted by turning a respective adjusting screw which is present to a predetermined maximum pressure and then cannot be further advanced toward the valve seat unless a setscrew in the respective end block assembly is retracted from locking engagement with a ring thereon. This ring provides a radial limiting pin which restricts turning of the adjusting screw to less than one turn by way of engagement with a stop pin projecting from the adjusting screw. The setscrew for the ring in each adjusting mechanism is not set until the adjusting screws have been initially turned relative to the end block assemblies to a position corresponding to maximum spring pressure. During this initial turning of the adjusting screws, the stop pins engage the limiting pins and cause the rings to then turn with the adjusting screws. Subsequent settting of the set screws locks the rings against turning movement relative to the end block assemblies.

BRIEF DESCRIPTION OF THE DRAWINGS

In the accompanying drawings:

FIGS. 3 and 4 are sectional views taken as indicated by the lines 3—3 and 4—4, respectively, in FIG. 2.

BEST MODE FOR CARRYING OUT THE INVENTION

Figure 1:
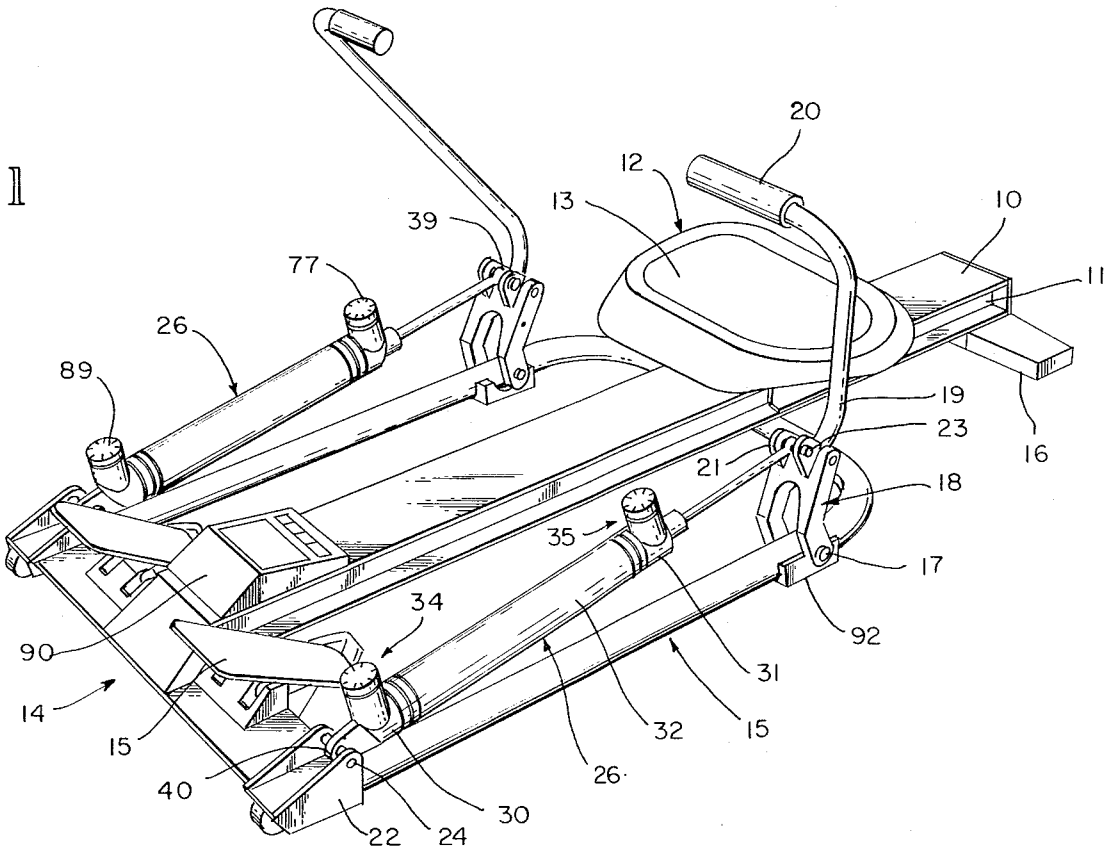
FIG. 1 is a perspective view of an exercise rowing machine embodying the present invention.
Figure 2:
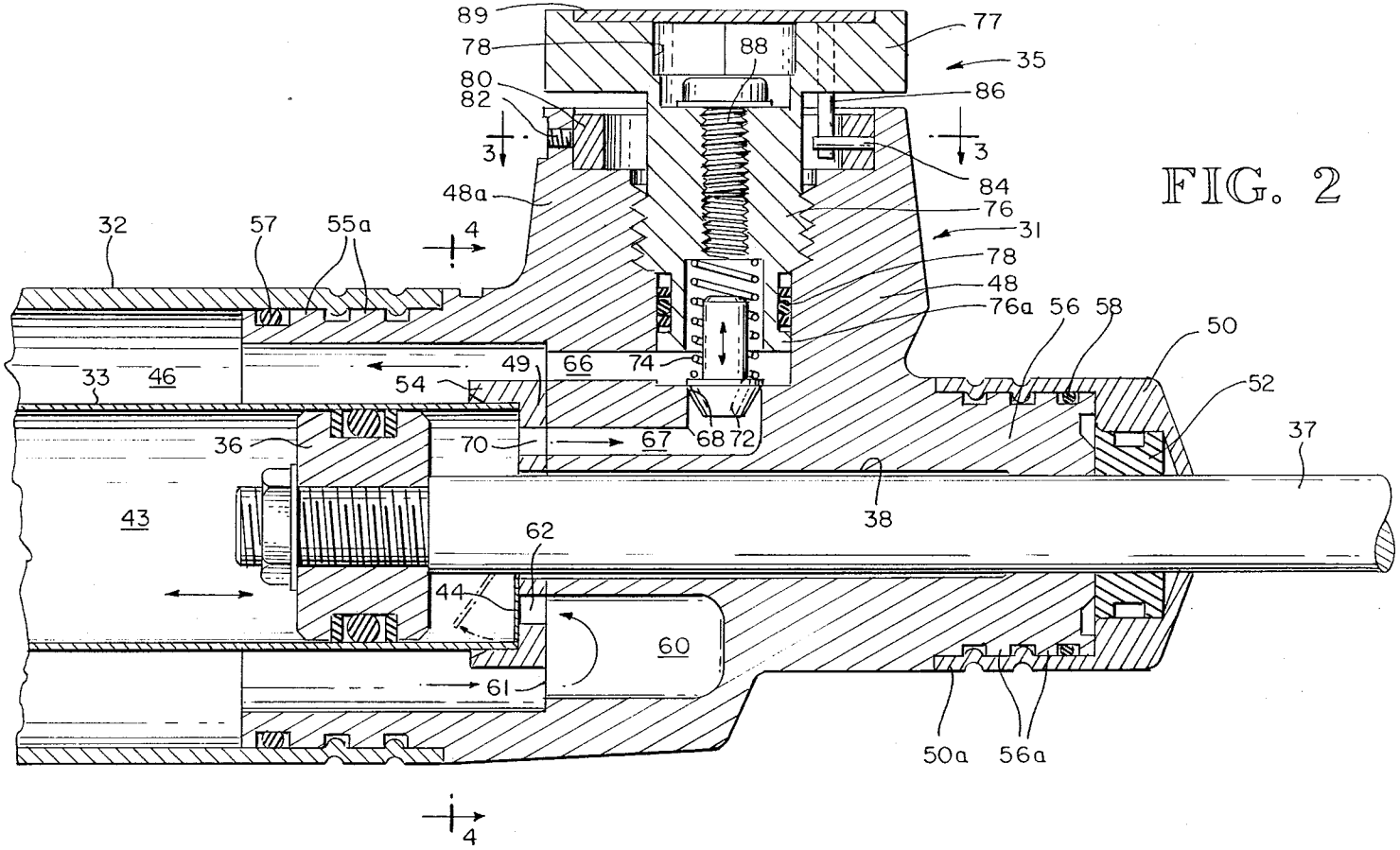
FIG. 2 is a fragmentary longitudinal sectional view to an enlarged scale of a rear portion of the load-resisting assembly.

Referring to FIG. 1, the invention is illustrated applied to an exercise rowing machine of the type having a longitudinal center rail 10 with side tracks 11 for sets of rollers presented by a seat carriage 12 having a seat 13 in an arrangement such as shown in U.S. Pat. No. 4,541,627. The center rail 10 is secured at its forward end to a front cross-member 14 on which a pair of foot plates 15 are pivotally mounted for vertical swinging movement. At its ends, the front cross-member 14 is connected to the legs of a U-shaped tubular frame member 15 which is connected at its center to the underside of the center rail 10. A rear cross-member 16 supports the rear of the center rail 10 and, together with the center rail, front cross-member 14, and U-shaped member 15, make up the frame of the machine.

Pivotally mounted at 17 on the U-shaped member 15 are a pair of fork units 18 which are secured to the lower ends of a pair of rowing arms 19 provided with hand grips 20. Each fork unit 18 has a pair of clevis ears 21 which are complemented by a pair of clevis ears 22 at the respective end of the front cross-member 24. Pivotally mounted by pins 23, 24 between the pairs of clevis ears 21 and 22 are a pair of adjustable hydraulic load-resisting assemblies 26 made in accordance with the present invention.

Each hydraulic load-resisting assembly 26 includes a hydraulic cylinder unit having front and rear end block assemblies 30, 31 which are interconnected by outer and inner concentric cylinders 32, 33 and have like front and rear flow control units 34, 35 mounted thereon. A piston 36 operates in the inner cylinder 33 and is connected to a piston rod 37 which projects rearwardly through a bore 38 in the rear end block assembly 31 to an eye fitting 39 to make the rear pivotal connection 21 with a rowing arm 19. The front end block assembly 31 provides an eye 40 to make the forward pivotal connection 24 with the clevis ears 22 on the front cross-member 14. Except for making provision for passage of the piston rod 37 through the rear end block assembly 31, and the eye 40 provided by the front end block assembly 30, the two end block assemblies 30, 31 are the same. Hence, only the rear end block assembly will be shown and described in detail.

The annular outer chamber 42 between the cylinders 32, 33 has a reservoir function and is connected at both ends to the interior 43 of the inner chamber 33 via like front and rear check valves 44 and via the like flow control units 34, 35. More particularly, when the piston 36 is stroked rearwardly, flow occurs from the rear of the inner piston chamber 43 to the rear of the outer reservoir chamber 42 via the rear flow control unit 34 while being otherwise blocked by the rear check valve 44, and flow responsively occurs from the front of the outer chamber 42 to the front of the inner cylinder 33 via the front check valve while being otherwise blocked by the front flow control unit 35. Similarly, when the piston is returned forwardly, flow occurs from the front of the inner chamber 43 to the front of the outer chamber 42 via the front flow control unit 35 while being otherwise blocked by the front check valve 44, and flow responsively occurs from the rear of the outer chamber 42 to the rear of the inner cylinder 33 via the rear check valve 44 while being otherwise blocked by the rear flow control unit 34. To compensate for the volume differential caused by the piston rod 37 within the inner cylinder 33, an air bag ring (not shown) may be provided in the outer chamber 42.

The rear end block assembly 31 comprises an end block 48, a circular porting member 49, and a seal-retaining member 50 confining an elastomeric ring 52. The front end block assembly 30 has a front end block which is basically the same as the rear end block 48, except that the bore 38 is not provided, and also has a circular porting member 49. The members 49 provide opposed annular mounting flanges 54 within which the end portions of the inner cylinder 33 are force-fitted. Matching opposed mounting necks 55 are provided by the end blocks 48 of the end block assemblies 30, 31 to receive the end portions of the outer cylinder 32. These necks 55 are circumferentially grooved, providing a plurality of annular lands 55*a* which are preferably knurled on their outer face. The wall of the outer cylinder 32 is crimped between the lands 55*a* to securely lock the outer cylinder to the end blocks in sealed relation. Similarly, at its rear end, the rear end block 48 has a rearwardly projecting neck 56 with annular lands 56*a* over which is crimped an annular mounting flange 50*a* at the front of the retaining member 50. Sealing O-rings 57, 58 are provided in circumferential grooves at the outer ends of the opposed necks 55 and the rear neck 56.

The end blocks 48 each have a bottom recess 60 which is partly covered by the porting member 49 to form a bottom return port 61, and each porting member 49 is formed with a bottom return port 62 registering with the upper portion of the mouth of the bottom recess 60. Each return port 62 is covered with a respective one of the check valves 44, which comprises a thin, flexible flapper valve of generally crescent shape. The check valves 44 are secured in place by a pair of bolts 64 which also secure the porting members 49 to the end blocks 48. Guide pins 65 for the end blocks 48 may also be provided.

The end blocks 48 are also formed with upper discharge passages 66, 67, which merge at a valve seat 68. Each discharge passage 66 is exposed to the outer chamber 42 above the respective porting member 49 and each discharge passage 67 is exposed to the inner chamber 43 by an upper discharge port 70 formed in the porting member 49. Flow from the inner chamber 43 to the outer chamber 42 via a port 70, discharge passage 67, valve seat 68, and discharge passage 66 is controlled by a respective frustoconical valve 72 which is biased toward the seat 68 by a compression spring 74 encircling the stem 72*a* of the valve. The spring 74 seats against the bottom of an adjusting screw 76 which has a bottom annular extension 76*a* housing the spring 74 and externally grooved to receive an elastomeric O-ring 78.

The adjusting screws 76 thread into respective bosses 48*a* at the top of the end blocks 48 and have enlarged, externally knurled heads to serve as manual turning knobs 77. Each knob 77 is preferably formed with a hexagonally shaped recess 78 to receive a hexagonal adapter for connection with a torque wrench for tightening the adjusting screws such that the springs 74 are compressed to a predetermined maximum pressure setting. Overriding of this maximum pressure setting is prevented by operation of a ring 80, a radial setscrew 82 in the boss 48*a*, a radial, inwardly projecting limiting pin 84 on the ring 80, and a stop pin 86 depending from the knob 77 for engaging the limiting pin 84. The ring 80 is knurled about its periphery and sits in a recess at the top of the boss 48*a* so that when the setscrew 82 is retracted, the ring is free to turn responsive to engagement of the stop pin 86 with the limiting pin 84 while the adjusting screw 76 is being turned by the torque wrench to its maximum pressure setting. Then the ring 80 is locked relative to the respective end block 48 by tightening the setscrew 82 against the outer face of the ring. This fixes the location of the limiting pin 84 and prevents the adjusting screw 76 from being further advanced because of engagement of the stop pin 86 with the limiting pin 84. With the maximum pressure setting for each valve spring 74 thus made, the adjusting screws 76 in the front and rear end block assemblies 30, 31 can then be independently retracted (backed off) from the maximum pressure setting a desired amount to lessen the spring pressure acting on the flow control valves 72 and thereby lessen the force required to reciprocate the piston 36 responsive to manual movement of the respective rowing arm 19. The retracting range of each adjusting screw 76 is limited to slightly less than one turn of the adjusting screw because the respective stop pin 86 will then again be brought into engagement with the corresponding limiting pin 84. Thus the full adjustment range of spring pressure is preset. For filling the hydraulic assemblies 26 with oil, the adjusting screws are provided with removable screw plugs 88.

It is preferred to have a set of numbered index markings on the knobs 77 for registering with a reference mark placed on the bosses 48*a* or outer cylinder 32 adjacent the knobs. The index markings may be placed on a face plate 89 fitting on the top of the knob. This permits users of the exercise machine to easily, independently set the exercise difficulty to a desired level for each exercise period by turning the knobs 77 to the respective setting. It also permits determination by a microprocessor of the work performed (calories used) and force per stroke exerted by the exercising person when the setting of each knob 77 is dialed in as an input to the microprocessor. The microprocessor is located in a housing 90 mounted at the front of the center rail 10 and is programmed to automatically time the back and forth strokes of the arms 19 and determine the length of such strokes by use of emitter/receiver circuitry and choppers located in foot housings 92 mounted on the underside of the U-shaped frame member 15 at the location of the fork units 18. Each chopper has a semi-circular row of light ports and is mounted at the lower end of one of the forks of each fork unit 18 so as to swing the row of light ports between the emitters and related receivers as the rowing arms are stroked. The number of interruptions of the emitter beams from the emitters to the opposite receivers per arm stroke indicates the length of the stroke, and the use of a pair of emitters/-receivers for each chopper permits determination of when the stroke direction has been reversed as well as a counting of the strokes during each exercise period. The microprocessor can be programmed to use the input from the emitter/receiver circuits, and the dialed-in input of the pressure settings in the load-resisting assemblies 26 to make various calculations including calorie consumption and force exerted per stroke, the results of which can be displayed in a suitable manner on the face of the housing 90.

Although the adjustable hydraulic load assemblies 26 have been shown applied to an exercise rowing machine, they are not limited to this use, and may be utilized on other exercise equipment, or as adjustable shock absorbers.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. An exercise machine comprising:

a frame;

an exercise arm pivotally connected to said frame at a pivot axis;

radially spaced inner and outer cylinders defining an inner chamber in the inner cylinder and an outer chamber between said cylinders;

end blocks interfitting with the outer cylinder;

end members interfitting with the inner cylinder and secured to respective said end blocks, and each inner cylinder having a pressure port and a return port communicating with the outer chamber via a pressure passage and a return passage, respectively, in the adjoining end block;

a double-acting piston in the inner cylinder having a piston rod extending through one of the end members and the respective end block, said piston rod and other end block being pivotally connected, one to said exercise arm and the other to said frame at a location remote from said pivot axis;

a respective check valve mounted on each end member for blocking flow from the inner chamber to the outer chamber through the respective return port;

a respective spring-loaded flow control valve in each pressure passage; and respective adjusting means for each flow control valve for independently adjusting the spring pressure on the flow control valves.

2. An exercise machine according to claim 1 in which each adjusting means comprises:

a screw member threaded into the respective end block and arranged to vary the spring pressure on the respective flow control valve; and respective limiting means for limiting the adjustment range of each screw member.

3. An exercise machine according to claim 2 in which each limiting means is adjustable and comprises:

a ring surrounding the respective screw member and presenting a first stop element;

a set screw for locking the ring to the respective screw member against turning; and a second stop element mounted on each screw member and arranged to engage the respective first stop element such that the screw member is limited to less than one revolution of turning adjustment when the ring is locked by the set screw from turning.

4. An exercise machine according to claim 2 in which one of said screw members has a fill plug extending axially therealong.

5. An exercise machine according to claim 1 in which an annular air bag is located in said outer chamber.

6. An exercise machine according to claim 1 in which each said check valve comprises a flapper valve mounted on the side of the respective end member facing the inner chamber.

7. An exercise machine according to claim 6 in which a respective pair of screws secures each end member to the respective end block and each flapper valve to the respective end member.

8. An exercise machine according to claim 1 in which each end member comprises a circular end plate screw-connected to the respective end block and an annular peripheral flange interfitting with the inner cylinder.

9. An exercise machine according to claim 8 in which each return passage comprises a recess in the respective end block which faces the respective end member and is exposed to the outer chamber and in which the respective return port extends through the respective end member from the inner chamber to the respective said recess.

10. An exercise machine according to claim 8 in which the outer cylinder is crimped onto opposed, circumferentially grooved, annular bosses provided by the end blocks in concentric relation to said annular peripheral flanges.

11. An exercise machine according to claim 1 in which the end block through which the piston rod extends has an outer boss surrounding the piston rod;

a retaining member connected to said outer boss and providing a journal for the piston rod; and a sealing ring on the piston rod, said sealing ring being retained by the retaining member between said outer boss and the retaining member.

12. An exercise machine according to claim 11 in which the other end block is formed with an eye for pivotal connection to another member.

* * * * *